US011629473B2

(12) United States Patent
Baykal

(10) Patent No.: US 11,629,473 B2
(45) Date of Patent: Apr. 18, 2023

(54) MULTIPLE FRICTION JOINT PILE SYSTEM

(71) Applicant: Ibrahim Gokhan Baykal, Istanbul (TR)

(72) Inventor: Ibrahim Gokhan Baykal, Istanbul (TR)

( * ) Notice: Subject to any disclaimer, the term of this patent is extended or adjusted under 35 U.S.C. 154(b) by 0 days.

(21) Appl. No.: 17/275,469

(22) PCT Filed: Sep. 4, 2019

(86) PCT No.: PCT/TR2019/050724
§ 371 (c)(1),
(2) Date: Mar. 11, 2021

(87) PCT Pub. No.: WO2020/112053
PCT Pub. Date: Jun. 4, 2020

(65) Prior Publication Data

US 2022/0034058 A1 Feb. 3, 2022

(30) Foreign Application Priority Data

Sep. 12, 2018 (TR) ..... 2018/13034

(51) Int. Cl.
*E02D 5/24* (2006.01)
*E02D 5/52* (2006.01)
(Continued)

(52) U.S. Cl.
CPC ..... *E02D 5/526* (2013.01); *E02D 5/24* (2013.01); *E02D 17/207* (2013.01); *E02D 31/02* (2013.01);
(Continued)

(58) Field of Classification Search
CPC combination set(s) only.
See application file for complete search history.

(56) References Cited

U.S. PATENT DOCUMENTS 3,918,229 A 11/1975 Schweinberger
6,176,055 B1 1/2001 Fu
6,634,830 B1 10/2003 Marshall

FOREIGN PATENT DOCUMENTS

CN 101368383 A 2/2009
CN 102561335 A 7/2012
(Continued)

OTHER PUBLICATIONS

International Search Report for corresponding PCT/TR2019/050724, dated Jun. 15, 2020.
(Continued)

*Primary Examiner* — Kyle Armstrong
(74) *Attorney, Agent, or Firm* — Egbert, McDaniel & Swartz, PLLC

(57) ABSTRACT

Disclosed is a multiple friction joint pile connection construction system to construct: shallow and deep foundations for structures, tie beam construction between footings, passive piles to prevent slope failures beam on elastic foundation, pile cap and tie beam in the construction of pile groups, load transfer platforms isolated (not connected) from the upper structure, retaining structure when constructed with vertical and horizontal orientation, vertical and horizontal drain when perforated blocks are used, landing pier, quay wall and platform construction for coastal and harbor structures, by anchoring to the upper section of the existing bored piles, by anchoring to the upper sections of the columns of the upper structure, in railroad tie manufacture, in transportation structures and in all kinds of similar geotechnical applications.

8 Claims, 10 Drawing Sheets

Figure 1:
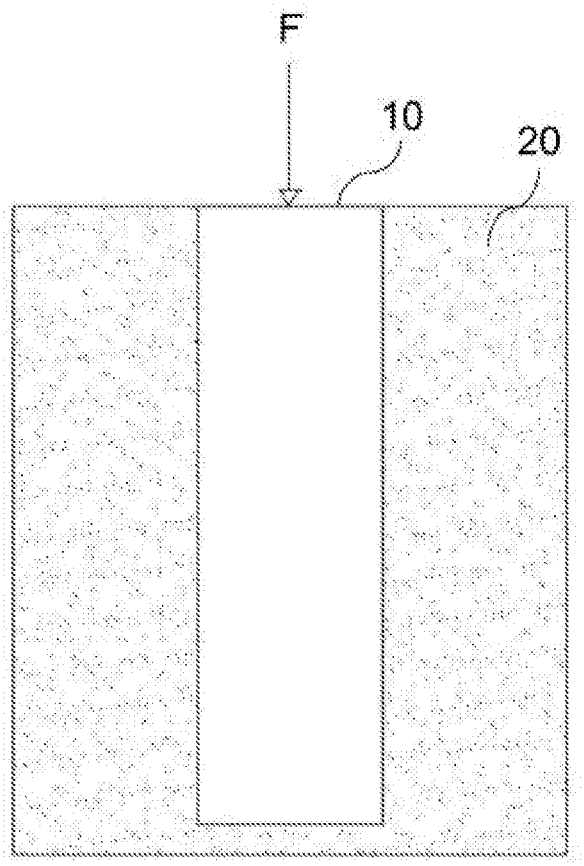

(51) Int. Cl.
*E02D 17/20* (2006.01)
*E02D 31/02* (2006.01)

(52) U.S. Cl.
CPC .. *E02D 2300/0034* (2013.01); *E02D 2600/20* (2013.01)

(56) References Cited

FOREIGN PATENT DOCUMENTS

| | | | |
|---|---|---|---|
| JP | S6233926 | A | 2/1987 |
| JP | H09310345 | A | 12/1997 |

OTHER PUBLICATIONS

Written Opinion of the International Searching Authority for corresponding PCT/TR2019/050724, dated Jun. 15, 2020.

MULTIPLE FRICTION JOINT PILE SYSTEM

TECHNICAL FIELD

The invention is related to multiple friction joint pile construction system to construct; shallow and deep foundations for structures, tie beam construction between footings, passive piles to prevent slope failures beam on elastic foundation, pile cap and tie beam in the construction of pile groups, load transfer platforms isolated (not connected) from the upper structure, retaining structure when constructed with vertical and horizontal orientation, vertical and horizontal drain when perforated blocks are used, landing pier, quay wall and platform construction for coastal and harbor structures, by anchoring to the upper section of the existing bored piles, by anchoring to the upper sections of the columns of the upper structure, in railroad tie manufacture, in transportation structures and in all kinds of similar geotechnical applications.

STATE OF ART

The invention U.S. Pat. No. 3,918,229A is a base column plate assembly using column base members to absorb concentric loading as well as shear or momentum. The anchor elements are described as transferring stresses along their entire length, allowing the use of a substantially smaller base plate.

The invention in U.S. Pat. No. 3,918,229A is characterized by steel bars perpendicular to the base plate placed under the base plate and rod ties for connecting these bars together. In addition, a membrane is placed between the base plate and the rods. Reinforcing bars, base plate and other elements that make up the system are located in a concrete structure. It is understood from the relevant document that this system does not prevent the fracture of the rigid rods and other fasteners but only delays the possibility of fracture, and this is even declared by the inventor.

The modular foundation system disclosed in document numbered U.S. Pat. No. 6,176,055B1 is related to a fixed foundation system equipped with multiple coupling elements and a special locking mechanism and it cannot prevent breakage due to its rigid structure when subjected to horizontal loads and it is characterized as follows.

"A column support assembly adapted to support a structural load-bearing column or the like capable of withstanding vertical loads, shear forces and momentum, characterized in that said column support assembly comprises a flat, relatively thick steel base plate, wherein said base plate comprises an upper column supporting surface and a base surface, steel reinforcing bars of substantial length which are fixed to said lower surface and extend downward from the lower surface which is substantially normal to said base surface of said base plate, a relatively thin compressible membrane placed between the bottom surface of said base plate and the upper surface of said concrete mass on the said base plate area surrounding said bars and at and extending towards the lower part of the lower ends of said rods; forces applied to said column, forces applied to said column; the base plate and the membrane are compressed to said rods before the forces are formed. A substantial portion of the initial force exerted on said concrete and transferred through said base plate is gradually distributed to the supporting concrete adjacent to said bars, thereby preventing a concentration of initial force on the concrete just below said base plate and said membrane consists of substances just below the base plate; it has less compression and more elasticity than the supporting concrete where the membrane is placed."

The art of articulating construction of the invention is used in the literature in order to form the superstructure using prefabricated elements, especially in bridge constructions. The object is to facilitate the construction method. The structure formed has high rigidity. Another application is to reinforce the bridge piers by placing articulated prefabricated elements around the pier so as to reinforce the existing bridge piers. This also creates a rigid structure. Segmental piles are used for reinforcement under existing buildings. Because the piles consist of rings, the prefabricated piles are placed and pushed down with the help of a jack due to the limited space. The pile pieces are rigidly connected to each other by bolts. There is no difference other than the way in which piles are formed from standard piles.

All the methods outlined above are methods based on joining prefabricated parts instead of standard elements and whose basic working principles are similar to standard construction elements. The purpose of the use of prefabricated elements is only to ensure or facilitate construction. Prefabricated elements are strongly fixed to each other to form a continuous element. In other words, the object is to obtain a continuous column or beam. After the production is completed, the system is intended to work as a continuous system, not as a fragmented system. The disadvantage of these methods is high rigidity. They are subject to large loads due to their limited displacement under lateral loads. In order to bear these large loads, the cross-section must also be large.

DESCRIPTION OF THE INVENTION

The present invention relates to a multiple friction joint pile system to eliminate the aforementioned drawbacks and provide new advantages to the relevant technical field.

There are many joints along the pile formed by anchoring small blocks to each other and the frictional force in these joints withstands the forces applied in the lateral direction. The friction resistance of the joints can be changed by increasing or decreasing the stress applied to the anchor. Since the hole through which the anchor passes is 3-5 D larger than the anchor diameter, each block can move in these amounts in the horizontal direction relative to the other so that the total horizontal displacement along the pile can reach up to one-third of the pile length.

When the piles are subjected to horizontal loads, they break when they are overloaded due to their rigid properties. Since their lateral flexibility is limited, they transfer incoming loads directly to the structure. And this requires non-economic dimensions. It is not possible to reuse the pile after it is broken.

The pile embodiment of the invention solves the aforementioned problems since it allows the rigidity to be adjusted from flexible to rigid. The pile functions even under large displacements and do not lose its capacity completely.

It reduces the transfer of lateral loads to the building thanks to its flexibility, which results in more economical solutions.

This flexibility is particularly advantageous in terms of lesser transfer of earthquake loads to the building. Since the large displacements of the piles connected to the building will be problematic, the multiple friction joint pile system of the invention can be used to create load transfer platform without being directly connected to the building and the foundations of the building can be built on this platform.

This pile system, which can also be used outside the building structure, can be directly connected to the building so that it can work together with the building. This allows the control of the behavior of the upper structure by adjusting the rigidity of the pile system.

Another important feature of the invention is that the targeted system is not a continuous system, but an articulated structural system which may be composed of anchored but independently movable parts. Even a single pile works as a structural system, not as a continuous column. The surface friction of the parts constituting the system is the main component forming the lateral capacity.

Friction between parts (bearing elements) can be increased or decreased by tensioning the anchor passing through the parts. The rubber membrane placed between the concrete blocks (referred to as geomembrane) allows the pile to flex in both the vertical and horizontal directions. The use of rubber, etc. in the articulations is particularly useful for vibrations in both the vertical and horizontal directions, but it is not mandatory for the lateral displacement of the pile. The lateral movement is achieved by the fact that the anchor hole is three to five times larger than the anchor diameter. Since there are many joints along the pile, these displacement amounts are physically capable of lateral movement up to one-third of the pile length.

Another important feature of the invention is that the pile system does not need mobilization of expensive pile manufacturing equipment and can be manufactured on-site and anywhere in the world with locally available low technology. Although it can be manufactured with low technology, it has much more technical advantages than those of piles made with expensive piling equipment. In case a small-diameter drilling rig is used, the anchor can be placed to deeper layers and piles can be formed to desired length (e.g. at the last three to four meters) of the anchor. A simple excavator (backhoe) is sufficient for the placement of the pile. The pile system will be placed in the trench (typically 3-4 meters deep and 0.5-0.6 m wide) to be excavated along the pile and the trench will be backfilled with sand, crushed stone or flowable fill. The flowable fill is an economical filling method with controlled compressive strength using a small amount of cement or fly ash, sand, and water and this filler can be designed to be manually excavated.

With the new innovative property of the new pile system whose rigidity and anchoring force can be changed by tightening or loosening a screw, the upper structure and the base structure (foundation) can be tuned. In the building-foundation system, it is possible to optimize the interaction or even to change it seasonally by adjusting the rigidity of the foundation. Locally available methods for tightening and loosening the anchor passing through the pile; anchorage tensioning machine or other methods may also be used.

It provides great advantages in transferring the earthquake loads to the building, reducing the vibrations of the machine foundations and in damping the vibrations of the transportation systems that create large vibrations such as high-speed trains.

Passive rigid piles used to retain the slopes cannot withstand large displacements caused by the movement of the slopes and break. In order to prevent this, piles of very large diameters are formed.

Since the rigidity of the jointed pile can be adjusted by the present invention, first the lateral loads acting on the pile are reduced. The lateral displacement caused by the movement of the slope can be controlled without breaking the pile due to the flexing of the pile. Even if the pile is fully flexed and stays in the flowing area, it is still useful to control the sliding slope. The flexibility of the pile is also an advantage for protecting buildings against explosions.

The invention can also be used in the foundation and retaining structures of the landing pier, coastal fills, and in quay platform foundations. It is possible to create both more economical, safer and longer-lasting systems due to the damping of repeated long term wave loads and their transfer to the structure because of its flexible structure. The product of the present invention can completely replace the pile in all of the above-described types of structures, and in the cases where much larger loads need to be transferred to the deeper layers, a jointed section can be formed by implementing the pile system on the anchor end at the top of the existing pile. Thus, while the main portion of the pile controls vertical settlement, the articulated pile structure formed on the top allows for the damping of especially lateral loads. Although the method can be used in all structures affected by wave loads, it is especially useful in the foundations of docks, wharfs and wind turbines, etc. While an articulated section can be formed in the upper section of the pile in all cases described above, a region around the pile can be formed by circumferentially placed jointed piles to dampen the horizontal loads acting on the existing pile.

When the concrete blocks used in pile manufacturing are manufactured with holes, the pile system can be used as vertical and horizontal drains. Since current drains only allow water outflow and cannot withstand loads, they lose their function when the water is drained. Multiple friction joint pile drain acts as both a drain and a pile during the service life of the structure. Another advantage of such pile manufacturing is that it allows the injection of cement slurry, chemical or other materials into the ground using these channels. In this way, a new combined soil improvement system is created. This newly developed pile system will ensure water outlet during the earthquake and meet the horizontal forces coming to the structure on liquefaction soils in earthquake zones.

It can be used along the axis of the pipeline, in the form of a beam perpendicular to the axis or in the form of a pile along the axis or as a combination thereof, in the sections needed to support all pipelines. It is especially useful for tolerating the thermal stresses to which the pipeline is exposed and for damping loads caused by natural disasters such as earthquakes and floods.

When the pile system developed is used by anchoring to the top sections of the columns in the superstructure of industrial buildings such as large span factory, hangar, airport, etc.; in sections where light roof systems will be connected to the columns, it will damp and transfer the wind and earthquake loads suffered by the roofs of such structures.

DRAWINGS

Embodiments of the present invention briefly summarized above and discussed in more detail below can be understood by reference to the exemplary embodiments described in the accompanying drawings. It should be noted, however, that the accompanying drawings only illustrate the typical structures of the present invention and therefore, they will are not intended to limit the scope of the invention, since it may allow other equally effective structures.

FIG. 1—Monolithic pile included in the prior art

Figure 2:
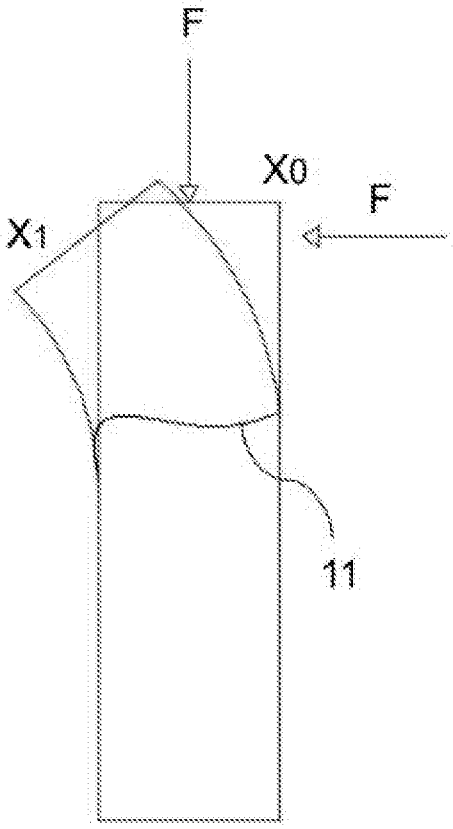

FIG. 2—Monolithic pile under the lateral force F included in the prior art

Figure 3:
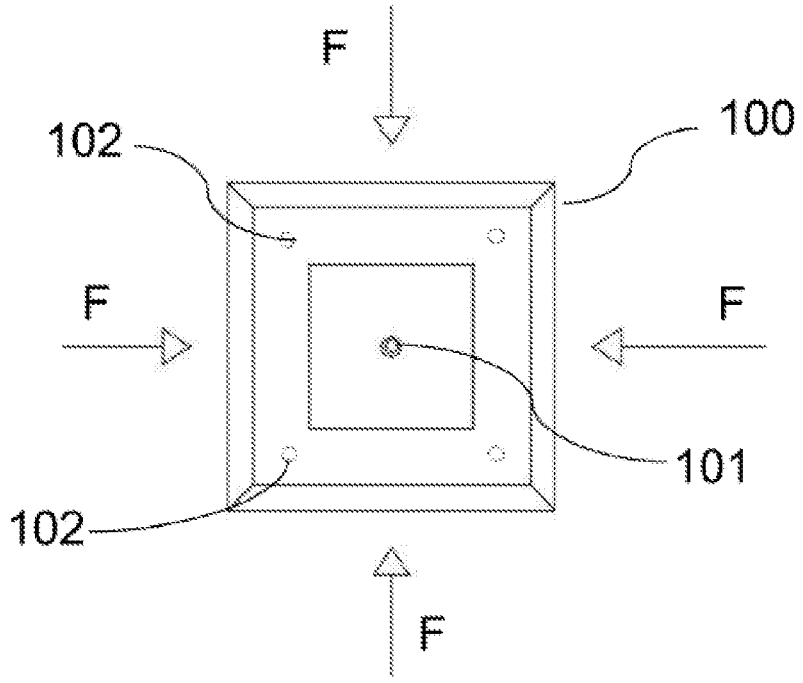

FIG. 3—F forces that can affect the block and the top view of the block

Figure 4:
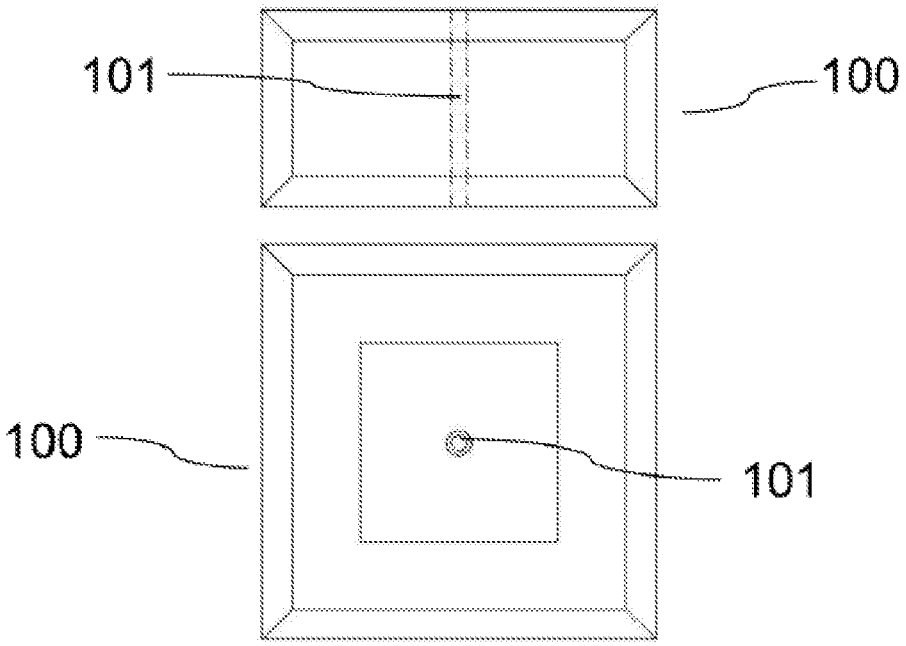

FIG. 4—Left side and top view of the block

Figure 5:
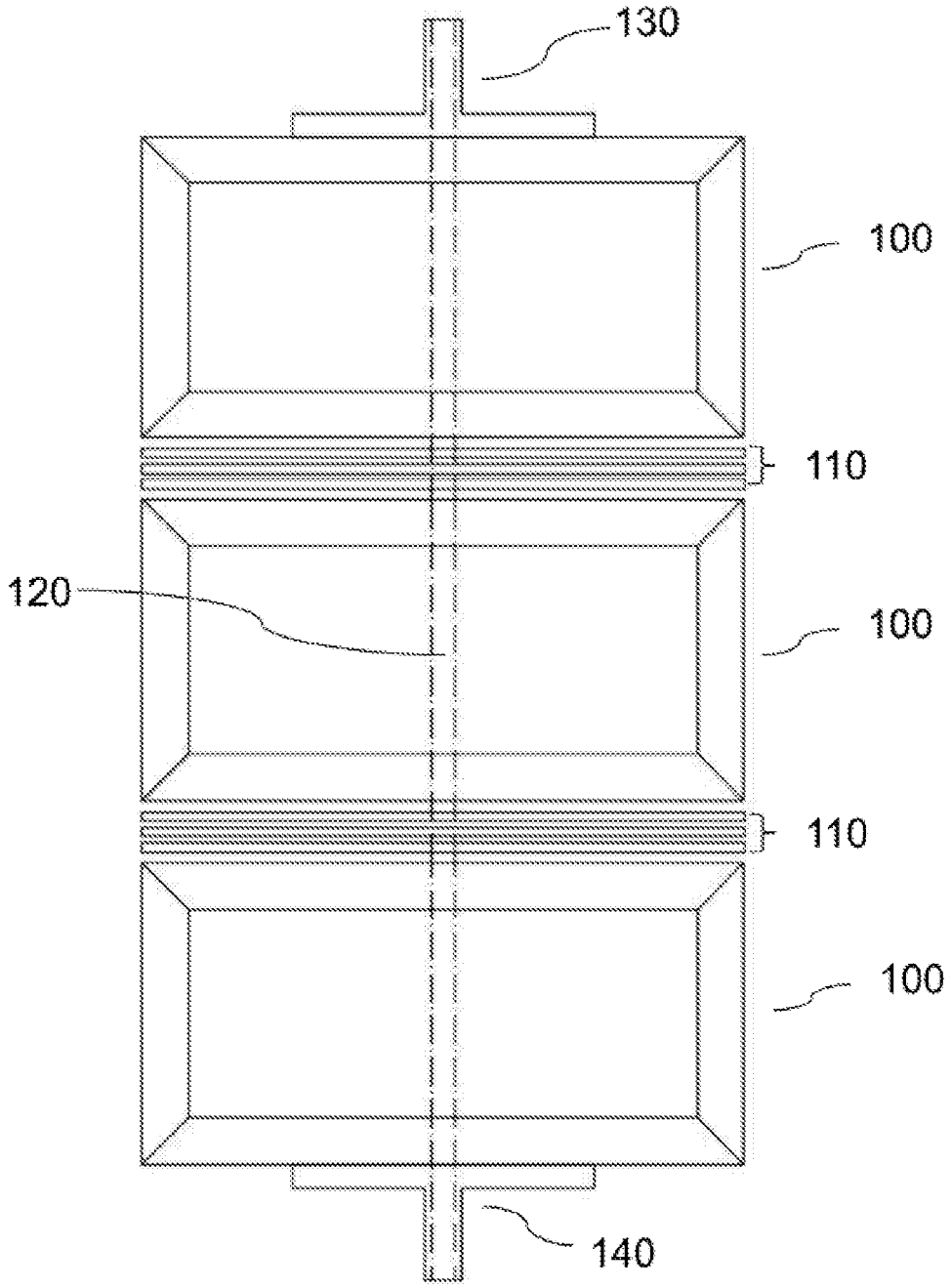

FIG. 5—Representative view of block junction detail

Figure 6:
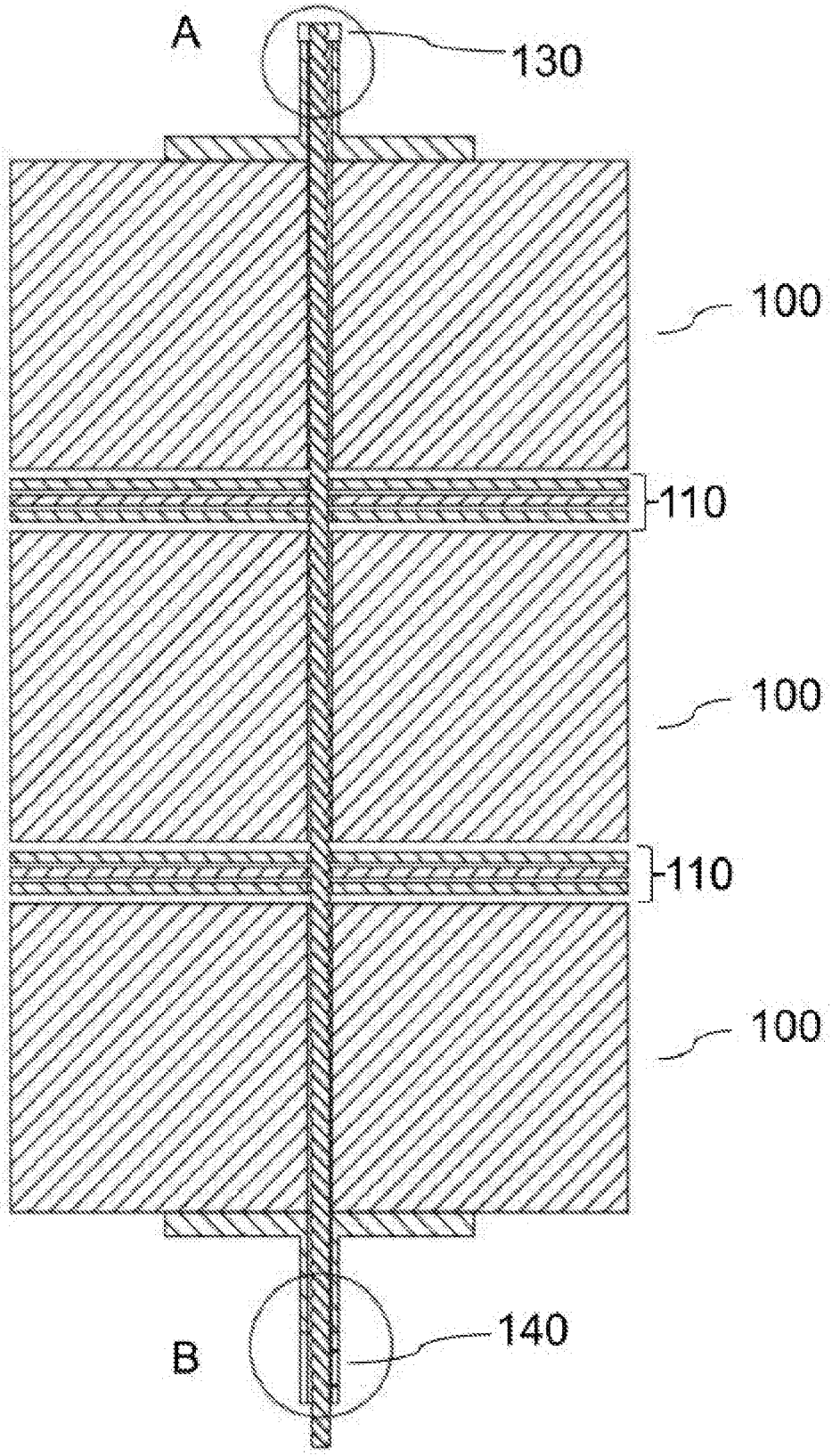

FIG. 6—Representative cross-sectional view of the block junction detail

Figure 7:
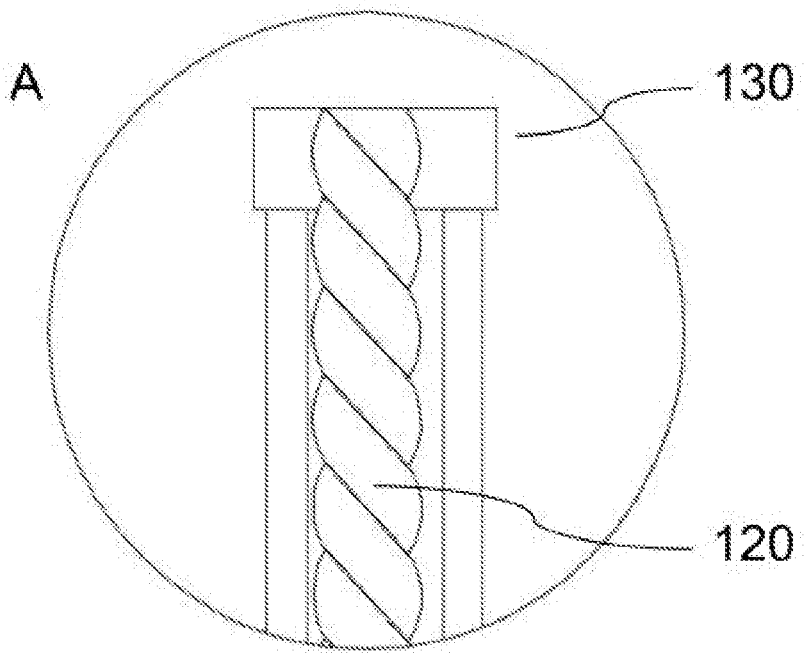

FIG. 7—Section A view

Figure 8:
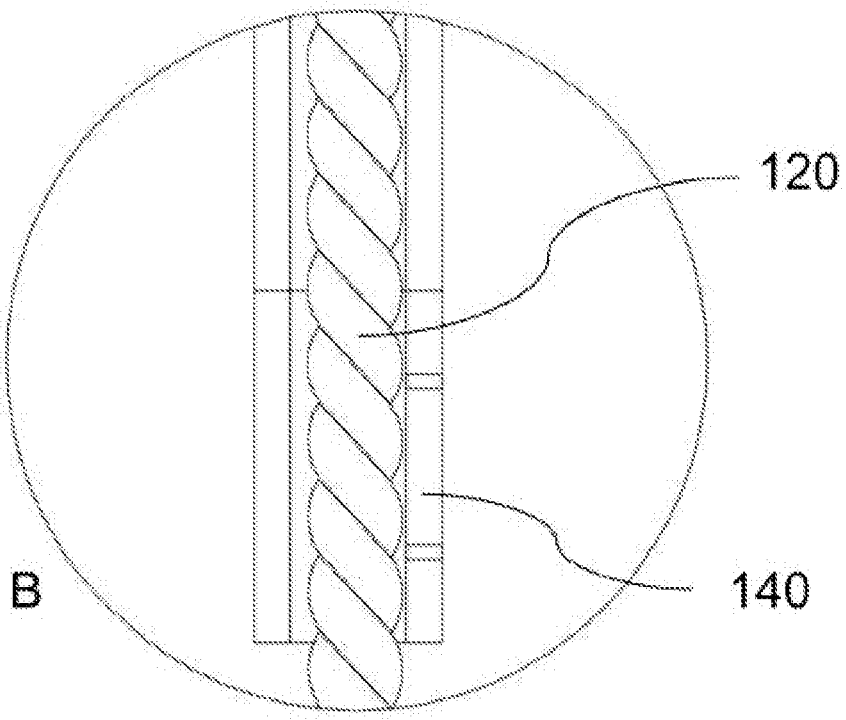

FIG. 8—Section B view

Figure 9:
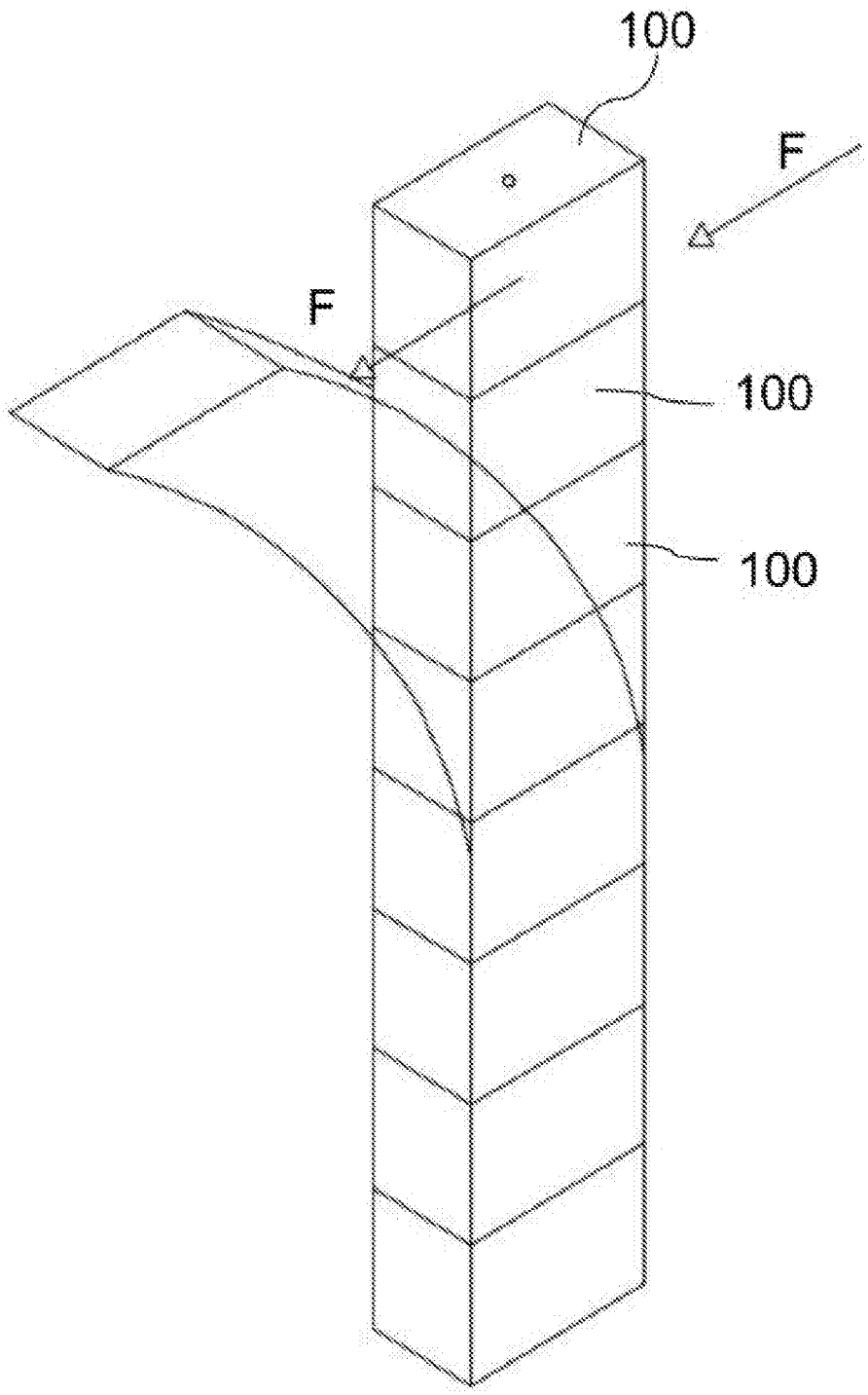

FIG. 9—Perspective view of representative deformation under lateral force

Figure 10:
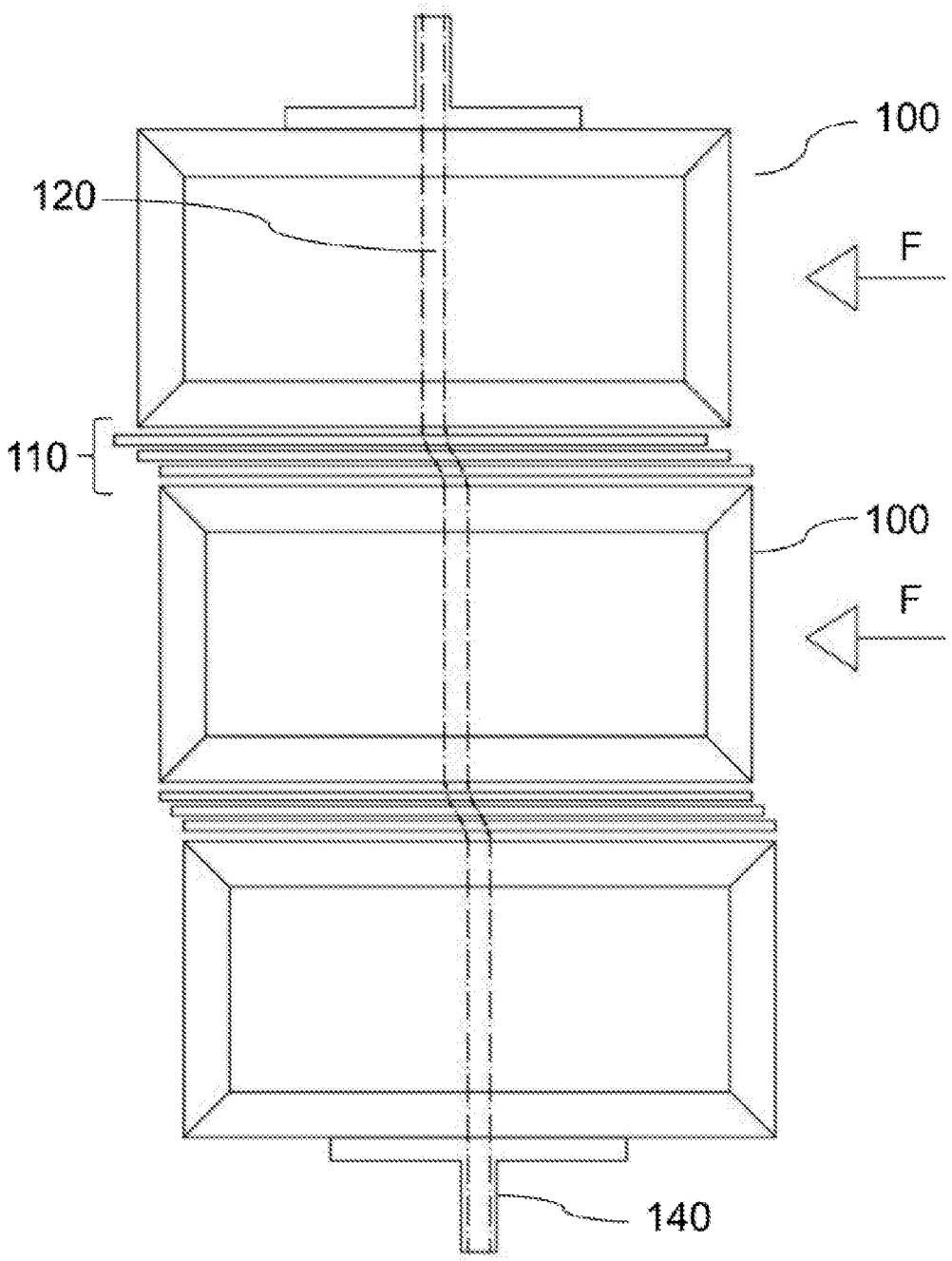

FIG. 10—Representation of movement of blocks under lateral force

Figure 11:
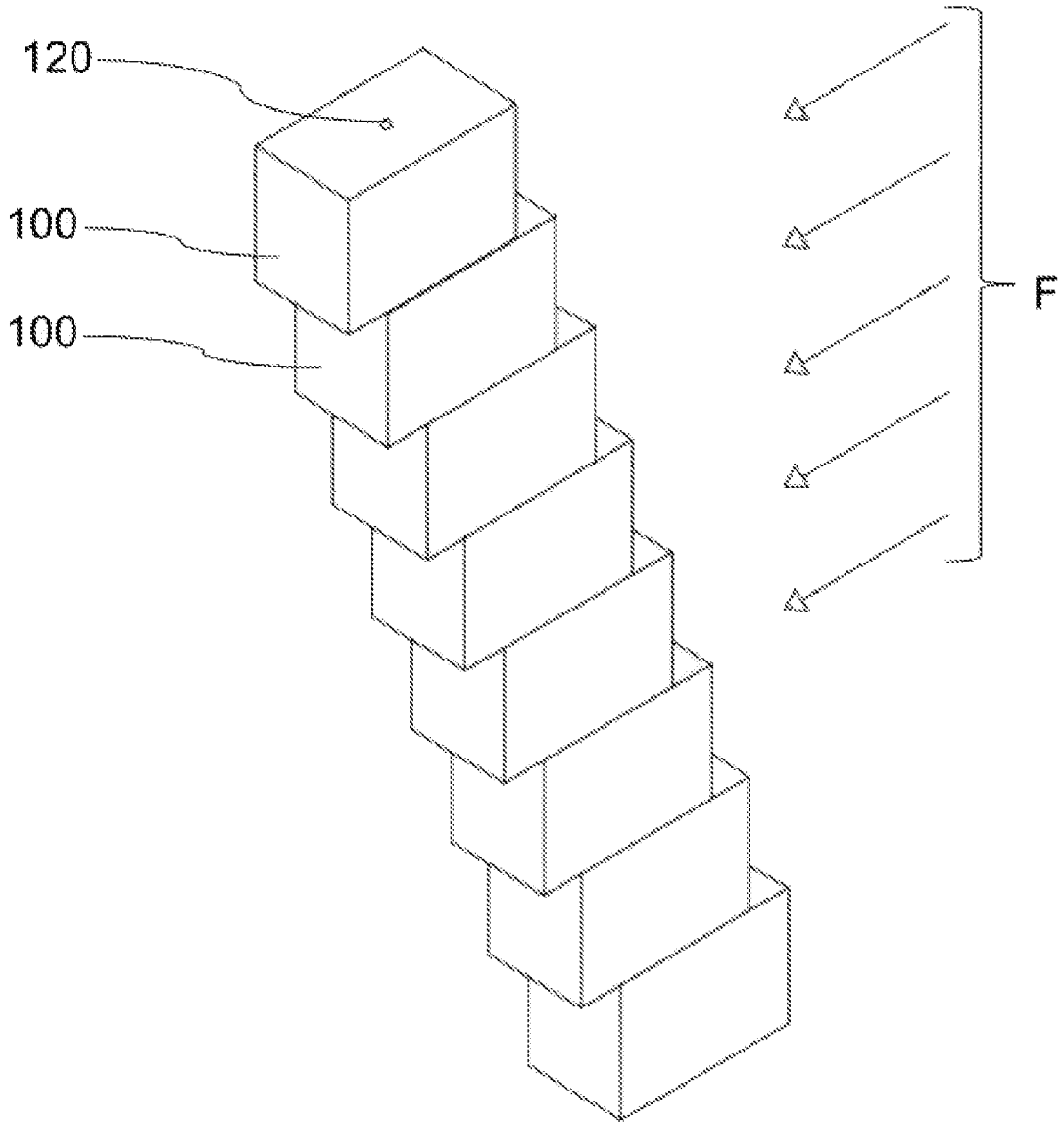

FIG. 11—Representation of combined movement of blocks under lateral force

Figure 12:
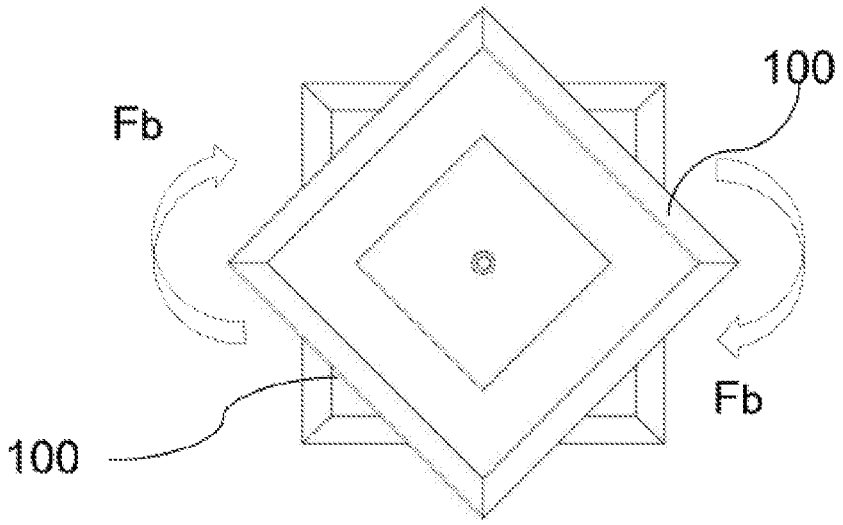

FIG. 12—Behavior of concrete block under the effect of torsional moment

Figure 13:
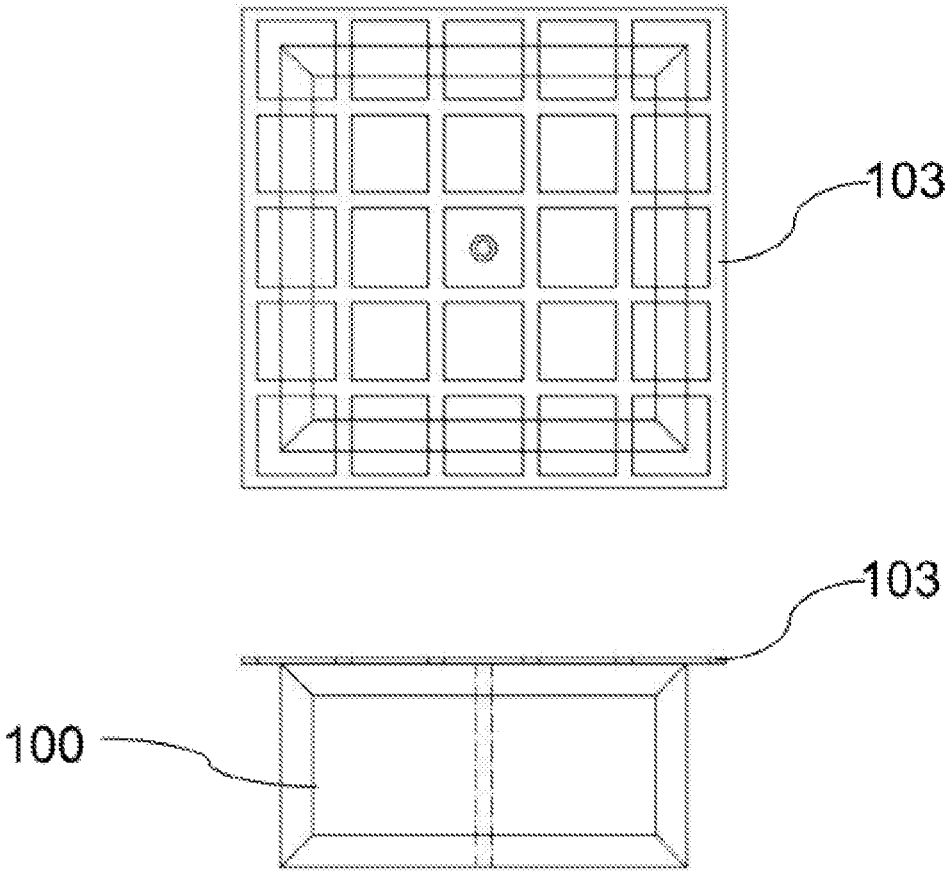

FIG. 13—Top and side view of geogrid over the block.

Figure 14:
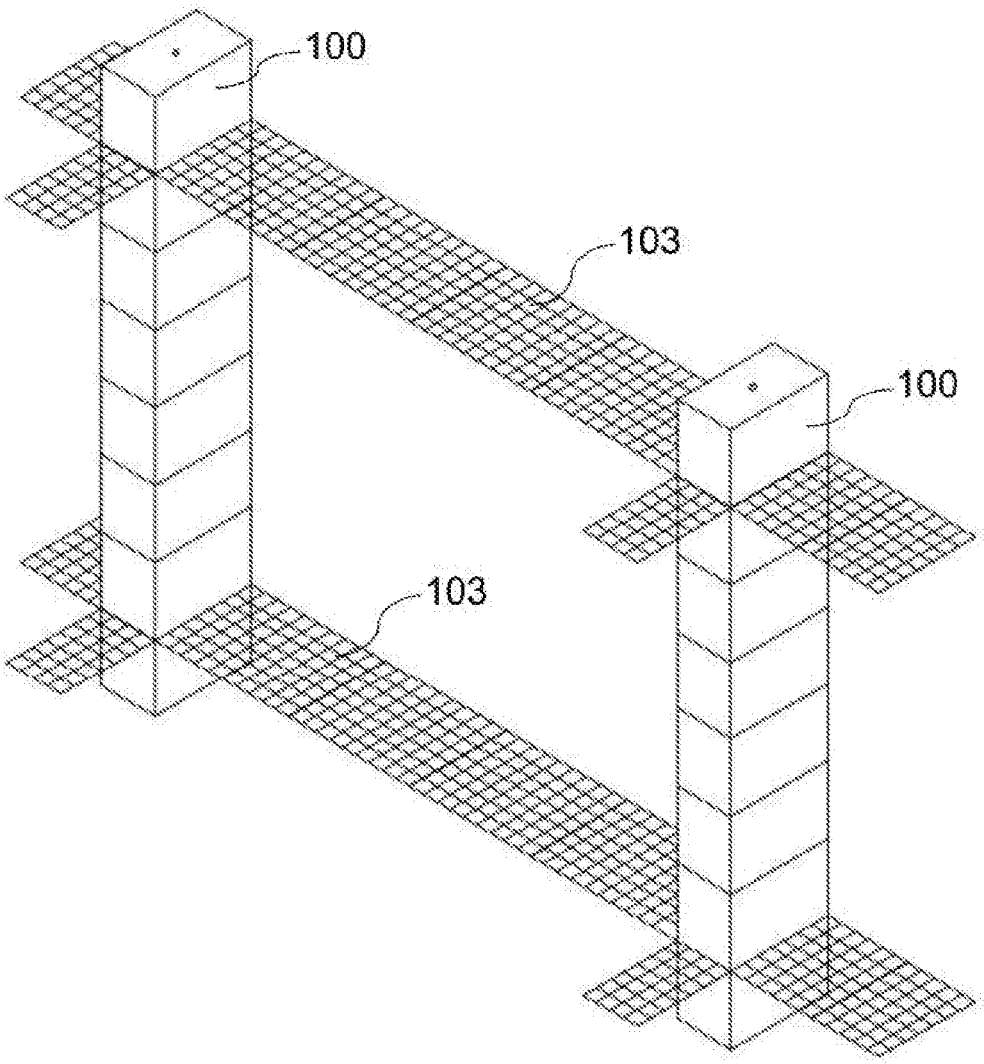

FIG. 14—Connection of neighboring piles with geogrid squeezed between the blocks.

Identical reference numbers are used where possible to identify identical elements common in the figures to facilitate understanding. The figures are not drawn with a scale and can be simplified for clarity. It is contemplated that the elements and features of an embodiment may be usefully incorporated into other embodiments without further explanation.

DESCRIPTION OF THE DETAILS IN THE DRAWINGS

10—Monolithic pile
11—Fracture or crack
20—Soil, filling, etc.
100—Bearing element
101—Twisted wire duct
102—Drainage channel
103—Geogrid
110—Flexible plate
120—Twisted wire
130—Twisted wire tightening and loosening apparatus
140—Twisted wire fastening apparatus
F—Acting force
$F_b$—Torsional Moment
$X_0$—Pile first position
$X_1$—Pile second position
A—Twisted wire tightening and loosening apparatus section detail
B—Twisted wire fastening apparatus section detail

DETAILED DESCRIPTION OF THE INVENTION

In this detailed description, preferred alternatives of multiple friction articulated pile embodiment of the invention are described only for a better understanding of the subject and without any limiting effect.

The invention comprises a bearing element (100) comprising at least two parts and preferably at least one twisted wire duct (101) positioned at any point on the bearing element (100), wherein the twisted wire duct (101) is long enough to connect the bearing elements (100) passing through the duct in the amount to meet the need. The diameter of the twisted wire duct (101) must be at least three to five times the diameter of the twisted wire. This gap allows movement in the lateral direction. In order to prevent contact between the twisted wire and the bearing element, the twisted wire is passed through a hose and this structure is passed through the twisted wire duct. The bearing element can be solid or perforated. It is not necessary for this element to be concrete; different materials such as wood, steel, composite, stone-filled cage, etc. can also be used. The important feature is the presence of a hole where the anchor will pass through the block and if the material forming the block consists of grains, it must be permanently bundled.

The invention comprises a geomembrane (rubber, cut waste car tire, geofoam, etc.) of the thickness required by the project placed between two bearing elements (100). However, it is not necessary to have a geomembrane for horizontal displacement. The soft material will be useful in preventing vibrations in the vertical and horizontal directions.

The invention is held together by a sufficient amount of bearing elements (100) and twisted wire (120) which is passed through the twisted wire duct (101) located on the flexible plates (110) placed between said bearing elements (100). The twisted wire (120) can be adjusted by loosening and tightening from its top and it is connected by a twisted wire tightening and loosening apparatus system. This tightening and loosening apparatus can be dywidag, anchor 4-cone or gripper. The lower part of the twisted wire (120) includes the twisted wire fastening system (140). Here, terminal or gijon systems, etc. with headless setscrew can also be used.

Among the figures used to make the invention more understandable, FIG. 1 and FIG. 2 illustrate the pile system used in the prior art and the disadvantage thereof.

FIG. 2 shows the movement of the monolithic pile under the lateral force F from the point X0 to the X1, and the fracture or crack 11 creation status of the monolithic pile under the force F. These pile systems built on the foundations of structures such as buildings, bridges, etc. break when the ground is exposed to earthquakes or other natural factors. The product and system of the invention developed to prevent this are explained in more detail below with the figures.

FIG. 5 illustrates a representative connection of the rigidity-adjustable pile system with large displacement, wherein the system is connected together with the bearing element 100 and the flexible plates 110 positioned between said bearing element 100 and the twisted wire 120 used to keep the system together by passing through the bearing elements 100 and the flexible plates 110 and twisted wire tightening and loosening apparatus 130, which is connected to said twisted wire 120 preferably on the upper section, and the twisted wire fastening apparatus 140, which is connected preferably from the bottom.

FIG. 6 is a cross-sectional view of the representative connection of FIG. 5.

FIGS. 7 and 8 show sections A and B, respectively. Section A shows the tightening and loosening section and section B shows the fastening section. However, the connections shown in these two figures are representative and are included to make the invention more understandable, and have no limiting effect.

FIG. 9 shows a representative operating mode of the multiple friction pile system.

FIG. 10 illustrates how the multiple friction pile system operates in the event of axial shift, and the individual effect of the lateral force F in which the bearing blocks 100 are affected from any direction on the bearing blocks 100 is shown. Here, the bearing elements 100 shifting due to the force F are movable since they are designed as independent units. When the twisted wire 120 is overloaded inside the multiple friction articulated pile system, it can be loosened with the help of the twisted wire tightening and loosening apparatus 130 located on the upper part and the load on the twisted wire 120 can be reduced. Similarly, in cases where it is desired to tighten the twisted wire 120, the desired tension is obtained by tightening the tightening and loosening apparatus 130. The possibility of fracture and/or cracking of the column is eliminated by the multiple friction articulated pile system placed under the structure this way.

The pile system formed also withstands the torsional forces with the frictional force in the joint planes. Exceeding this strength will not cause the pile to twist, but this block will only rotate. This feature will minimize the torsional problems especially in pile groups.

In the present invention, it is also possible to use the pile for drainage in the horizontal and vertical directions by the holes formed in the horizontal and vertical directions of the bearing elements 100. These holes are separate from the twisted wire hole. These holes on the bearing elements 100 provide the discharge of water in the pile well. When necessary, cement slurry, lime slurry, chemical, bentonite, etc. mixtures can also be fed to the ground with the help of these ducts. This has created a new combined soil improvement method.

Additionally, piles can be created by using one or more geogrids 103 instead of geomembranes in the articulations and the geogrids 103 can be connected to each other from the upper region and the lower region of the articulated pile. The frames thus formed can be used in geotechnical applications such as forming deep foundations, retaining structures, approach embankments, platforms, etc. Geogrids 103 are anchored in the upper section of the pile by squeezing between the concrete blocks and provide additional bending rigidity during lateral loading after being placed on the pile surface along the pile, and then being anchored between the concrete blocks at the other end of the pile. When the same operation is performed on the other axis, an articulated pile is formed in which the bending strength is increased in both directions.

ABBREVIATIONS

D: Pile diameter

The invention claimed is:

1. A multiple friction joint pile system comprising:

at least two carrier elements;

a twisted wire connecting said at least two carrier elements;

at least one flexible plate positioned between said at least two carrier elements and adapted minimize a vibration of said at least two carrier elements;

a twisted wire tightening or loosening apparatus connected to said twisted wire;

a twisted wire fastening apparatus, wherein said at least two carrier elements have a twisted wire duct having a diameter three to five times larger than a diameter of said twisted wire, said twisted wire passing through the twisted wire duct, the twisted wire duct positioned at a point along said at least two carrier elements so as to allow independent lateral displacement and independent rotation of said at least two carrier elements relative to the twisted wire duct;

a pile system having at least one geogrid squeezed between said at least two carrier elements and adapted to create piles, the at least one geogrid and the piles being connected to each other from an upper region or a lower region of a multiple friction joint pile that is adapted to be placed in excavated trench backfilled with sand, crushed stone or flowable fill, the excavated trench having a width approximately equal to a width of the pile, said twisted wire tightening or loosening apparatus being connected to the upper region, said twisted wire fastening apparatus being connected to the lower region.

2. The multiple friction joint system of claim 1, wherein said at least two carrier elements are formed of a material selected from the group consisting of a wood, a steel, a composite, a stone-filled cage, a concrete and a reinforced concrete.

3. The multiple friction joint system of claim 1, wherein said twisted wire formed of a material selected from the group of a steel rope, a fiber rope and a steel wire.

4. The multiple friction joint system of claim 1, wherein said at least one flexible plate is formed of a material selected from the group consisting of a rubber, a car tire, a geofoam, a plastic, and a geomembrane.

5. The multiple friction joint system of claim 1, wherein said twisted wire has a monolithic structure.

6. The multiple friction joint system of claim 1, wherein said twisted wire has at least two pieces.

7. The multiple friction joint system of claim 1, wherein said twisted wire tightening or loosening apparatus is adjustable so as to be loosened or tightened.

8. The multiple friction joint system of claim 1, wherein said twisted wire tightening or loosening apparatus is positioned at the upper region of the multiple friction joint pile, said twisted wire tightening or loosening apparatus adapted to loosen said twisted wire when said twisted wire is overloaded inside the multiple friction joint pile, said twisted wire tightening or loosening apparatus adapted to tighten said twisted wire to a desired tension.

* * * * *